US006165342A

United States Patent [19]

Kuhn et al.

[11] Patent Number: 6,165,342

[45] **Date of Patent: *Dec. 26, 2000**

[54] CYANIDE-FREE ELECTROPLATING BATH FOR THE DEPOSITION OF GOLD AND GOLD ALLOYS

[75] Inventors: Werner Kuhn, Rodenbach; Wolfgang Zilske, Hanau, both of Germany

[73] Assignee: Degussa Hüls Aktiengesellschaft, Frankfurt am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/043,416

[22] PCT Filed: Jul. 21, 1997

[86] PCT No.: PCT/EP97/03903

§ 371 Date: Jun. 2, 1998

§ 102(e) Date: Jun. 2, 1998

[87] PCT Pub. No.: WO98/03700

PCT Pub. Date: Jan. 29, 1998

[30] Foreign Application Priority Data

Jul. 23, 1996 [DE] Germany ..... 196 29 658

[51] Int. Cl.[7] ..... C25D 3/48

[52] U.S. Cl. ..... 205/247; 205/250; 205/251; 205/267; 106/1.24

[58] Field of Search ..... 205/247, 250, 205/251, 267; 106/1.24

[56] References Cited

U.S. PATENT DOCUMENTS

| | | | |
|---|---|---|---|
| Re. 35,513 | 5/1997 | Nobel et al. . | |
| 3,057,789 | 10/1962 | Smith | 204/46 |
| 3,929,595 | 12/1975 | Biberbach et al. | 205/267 |
| 4,192,723 | 3/1980 | Laude et al. . | |

FOREIGN PATENT DOCUMENTS

| | | |
|---|---|---|
| 0693 579 | 1/1996 | European Pat. Off. . |
| 8-041676 | 6/1996 | Japan . |

OTHER PUBLICATIONS

Chemical Abstract 89: 119754, Oct. 1978.

*Primary Examiner*—Kishor Mayekar
*Attorney, Agent, or Firm*—Smith Gambrell & Russell, LLP

[57] ABSTRACT

Cyanide-free electroplating baths for deposition of gold and gold alloy coatings, using sulphurous gold complexes that are stable for a relatively long time, can be used with current density over 1 A/dm$^2$ and are practically odor-free, are obtained when the sulphurous compounds used are mercaptosulfonic acids, dye sulfide sulfonic acids or salts thereof.

12 Claims, No Drawings

CYANIDE-FREE ELECTROPLATING BATH FOR THE DEPOSITION OF GOLD AND GOLD ALLOYS

This application is a 35 U.S.C. 371 National Stage filing of PCT/EP97/03903 published as WO 98/03700 on Jan. 29, 1998.

DESCRIPTION

This invention relates to a cyanide-free, electroplating bath for the deposition of gold and gold alloy coatings, containing 0.5 to 30 g/l of gold in the form of a complex of a sulphurous compound, 0 to 50 g/l of an alloy metal in the form of water-soluble compounds of silver, copper, indium, cadmium, zinc, tin, bismuth, arsenic and/or antimony, 1 to 200 g/l of the free sulphurous compound, 0 to 200 g/l of conductive and buffer salts in the form of alkali metal borates, phosphates, citrates, tartrates and/or gluconates and optionally wetting agents and brighteners.

Today, electrodeposition of gold is primarily performed using electrolytes based on gold cyanide complexes which, at least under alkaline conditions, also contain relatively large quantities of toxic alkali metal cyanides. Under acidic and neutral conditions, the cyanide liberated on electrolysis escapes at least in part as highly toxic hydrocyanic acid. Apart from severe toxicity, baths containing cyanide also occasion problems when detoxifying the cyanide, which, in practice, is predominantly performed with alkali metal hypochlorite. This may result in the formation of so-called adsorbable halogen compounds (AOX) which cause waste water treatment problems. Efforts have accordingly long been made to produce gold electroplating baths without using the toxic complexing agent cyanide. However, with the exception of baths based on gold sulphite complexes, it has not hitherto proved possible to produce an industrially viable bath.

However, such gold/sulphite complexes have the disadvantage of low stability and, even with a large excess of free sulphite ions, form elemental gold once the solution has stood for a relatively extended period, so rendering the solution unusable.

Electroplating baths which contain the gold in the form of a thiosulphate complex (DE-PS 24 45 538) are also not substantially more stable. Like other known gold complexes with sulphurous compounds, they decompose partially if they are kept for a relatively extended period. In published application EP 0 611 840, the gold thiosulphate complexes are thus stabilised by the addition of sulphinates. The current density usable in these baths is limited and decomposition generally occurs at current densities of above 1 A/dm$^2$. Moreover, these baths usually cause an odour nuisance.

The object of the present invention was accordingly to provide a cyanide-free electroplating bath for the deposition of gold and gold alloy coatings, containing 0.5 to 30 g/l of gold in the form of a complex of a sulphurous compound, 0 to 50 g/l of an alloy metal in the form of a water-soluble compound of silver, copper, indium, cadmium, zinc, tin, bismuth, arsenic and/or antimony, 1 to 200 g/l of the free sulphurous compound, 0 to 200 g/l of conductive and buffer salts in the form of alkali metal borates, phosphates, citrates, tartrates and/or gluconates and optionally wetting agents and brighteners, which was also to be stable over a relatively extended period, to be operated at current densities of above 1 A/dm$^2$ and, to the greatest extent possible, to be neutral in odour.

SUMMARY OF THE INVENTION

This object is achieved according to the invention by the bath's containing the gold complex of a mercaptosulphonic acid, a disulphidesulphonic acid or mixtures of these compounds as the sulphurous compound.

The salts, preferably the alkali metal salts, of these compounds are also suitable.

The baths preferably contain 1 to 200 g/l of the free sulphurous compound or the alkali metal salts thereof in excess of the stoichiometric composition of the corresponding gold complex.

It is furthermore advantageous for the baths to contain 0.01 to 10 g/l of wetting agents in the form of surfactants and 0.1 to 1000 mg/l of brighteners in the form of selenium and/or tellurium compounds.

The bath is advantageously operated at a pH value of 7 to 12.

The sulphurous compounds which are suitable for the baths according to the invention exhibit good solubility in water and elevated stability, combined with a low vapour pressure, such that there is no perceptible unpleasant odour.

DETAILED DESCRIPTION OF THE INVENTION

The sulphurous compounds to be used according to the invention may be characterised by the general formula I $$X—S—CHR—(CR'R'')_n—SO_3H \quad (I)$$

in which

X means H or the residue —S—CHR—(CR'R")$_n$—$SO_3H$ R' and R"

R means H, alkyl or aryl containing up to 12 C atoms, $SO_3H$, OH, SH, $NH_2$ n means the numbers from 0 to 6.

Typical compounds of the formula I are:

2-mercaptoethanesulphonic acid, 3-mercaptopropanesulphonic acid, 2,3-dimercaptopropanesulphonic acid and homologues together with bis-(2-sulphoethyl)disulphide bis-(3-sulphopropyl)disulphide and homologues.

The compounds are preferably used in the form of the alkali metal salts thereof.

The corresponding gold complexes are obtained by simply reacting soluble gold compounds, such as for example tetrachloroauric acid, sodium aurate solutions or the like, with the stoichiometric quantity or an excess of these sulphurous compounds in an aqueous solution. Care must be taken to provide the stoichiometric quantity of sulphurous compounds required for reduction to gold(I). If the electroplating bath is to contain no chloride ions, the gold should first be precipitated with ammonia solution as fulminating gold, thoroughly washed and dissolved in an aqueous solution of the sulphurous compound.

The solution of the gold complex may be used directly for preparation of the electroplating bath. The bath preferably contains an excess of sulphurous compounds of 1–200 g/l.

Codeposition of further metals as well as gold from this system is possible in order to influence properties of the deposit. Codeposition of silver, copper, indium, cadmium, tin, zinc, bismuth and the semi-metals arsenic and antimony is of interest. They are used either in the form of the corresponding sulphur compounds, as is preferably the case with silver and copper, or in the form of other complexes with hydroxyl ions, with nitrilotriacetic acid or ethylenediaminetetraacetic acid (EDTA), as complexes with hydroxycarboxylic acids, such as gluconic acid, citric acid and tartaric acid, as complexes with dicarboxylic acids, such as oxalic acid, with amines, such as ethylenediamine, with phosphonic acids, such as 1-hydroxyethanediphosphonic acid, aminotrimethylenephosphonic acid or ethylenediaminetetramethylenephosphonic acid.

Bismuth is thus preferably used as a citrate or EDTA complex, tin preferably as oxalatostannate(IV) or tin(II) gluconate complex and indium as gluconate or EDTA complex. Arsenic and antimony are largely used to increase hardness and for brightening. Arsenic is preferably used in the form of alkali metal antimonyltartrate. The concentration of the alloy metals may vary within broad limits between 10 mg/l and 50 g/l. The concentration of the free complexing agent in the bath may be between 0.1 and 200 g/l.

Bright alloy deposits may be obtained by adding further brighteners, such as compounds of selenium and tellurium, for example as an alkali metal selenocyanate, selenite or tellurite, in concentrations of 0.1 mg/l to 1 g/l.

The addition of conductive and buffer salts, such as borates, tetraborates, phosphates, citrates, tartrates or gluconates of the alkali metals, in concentrations of 1–200 g/l increases the conductivity and throwing power of the bath.

The addition of 0.01–10 g/l of wetting agent not only reduces surface tension, but may also have a positive effect on brightening. Wetting agents used are, for example, ionic and nonionic surfactants of the ethylene oxide adduct type, such as alkyl (fatty acid) or nonylphenol polyglycol ethers with alcohol, sulphate, sulphonate or phosphate end groups together with perfluorinated compounds, such as perfluoroalkane carboxylates or sulphonates, together with cationic surfactants, for example tetraalkyammonium(sic) perfluoroalkane sulphonates.

According to the invention, the baths thus contain:

0.5–30 g/l of gold complexed with sulphurous compounds from the group comprising mercaptosulphonic acids or the alkali metal salts thereof.

1–200 g/l of free sulphurous compounds or the alkali metal salts.

0–200 g/l of conductive and buffer substances from the group comprising alkali metal borates, phosphates, citrates, tartrates, gluconates.

0–50 g/l of alloy metals from the group comprising silver, copper, cadmium, indium, tin, zinc, bismuth, arsenic and antimony in the form of the stated complexes and compounds.

0–1000 mg/l of brighteners from the group comprising selenium and tellurium in the form of selenite, selenocyanate or telluride of the alkali metals.

0–10 g/l of wetting agents, for example ionic and nonionic surfactants of the ethylene oxide adduct type such as alkyl(fatty acid) or nonylphenol polyglycol ethers having alcohol, sulphate, sulphonate or phosphate end groups together with perfluorinated compounds such as perfluoroalkane carboxylates or sulphonates together with cationic surfactants, for example tetraalkyammonium(sic)perfluoroalkane sulphonates.

The following Examples are intended to illustrate the invention in greater detail:

1. 5 g of gold as gold 2-mercaptoethanesulphonate complex, 20 g of 2-mercaptoethanesulphonic acid and 50 g of dipotassium phosphate are dissolved to yield a liter of solution. The pH value is adjusted to pH 10 with sodium hydroxide solution. On subsequent electrolysis at 50° C. and 1.5 A/dm$^2$, a smooth, uniformly adhering gold coating of a thickness of 5 $\mu$m is obtained on a copper cathode. The bath is virtually odourless and exhibits no signs of decomposition even after relatively extended electrolysis.
2. If 2 g of a copper 2-mercaptopropanesulphonic acid complex are added to the bath from Example 1, reddish gold/copper deposits are obtained on electrolysis.
3. If a further 0.3 g of potassium oxalatostannate(IV) and 400 $\mu$g of potassium selenocyanate are added as brighteners to the bath from Example 2 and electrolysis performed at 50° C. and 2 A/dm$^2$, bright, rose-coloured coatings of a gold/copper/tin alloy are obtained.
4. 4 g of gold and 2 g of silver as bis-(3-sulphopropyl) disulphide complexes, 30 g of (3-sulphopropyl) disulphide, 50 g of sodium gluconate and 20 mg of potassium tellurite are dissolved to yield a liter of solution. The pH value is adjusted to pH 12 with sodium hydroxide solution. On electrolysis at 55° C. and 1.5 A/dm$^2$, a bright, greenish-yellow, ductile deposit of a gold/silver alloy is obtained on a copper cathode.

We claim:

1. A cyanide-free electroplating bath for the deposition of gold and gold alloy coatings, comprising 0.5 to 30 g/l of gold, by weight of the gold, in the form of a gold complex, said complex being a complex of gold and sulfur-containing compound;

0 to 50 g/l of an alloy metal, by weight of the alloy metal, said alloy metal being in the form of a water-soluble compound of an element selected from the group consisting of silver, copper, indium, cadmium, zinc, tin, bismuth, arsenic, antimony and mixtures thereof;

1 to 200 g/l of a free sulfur-containing compound; and 0 to 200 g/l of a conductive and buffer salt, wherein the gold complex of at least one member selected from the group consisting of a mercaptosulfonic acid or salt thereof, a disulfidesulfonic acid or a salt thereof, and mixtures of these compounds, and the free sulfur-containing compound is at least one member selected from the group consisting of a mercaptosulfonic acid or a salt thereof, a disulfidesulfonic acid or a salt thereof, and mixtures of these compounds.

2. The cyanide-free electroplating bath according to claim 1, wherein said conductive and buffer salt is selected from the group consisting of alkali metal borates, phosphates, citrates, tartrates, gluconates and mixtures thereof.

3. The cyanide-free electroplating bath according to claim 1, wherein the sulfur-containing compound of the corresponding gold complex contains a compound of the formula I $$X—S—CHR—(CR'R'')_n—SO_3H$$

in which x represents H or the residue —S—CHR—(CR'R")$_n$—$SO_3H$;

R, R'and R" represent H, alkyl or aryl containing up to 12 carbon atoms, $SO_3H$, OH, SH, or $NH_2$; and n represents a number from 0 to 6.

4. The cyanide-free electroplating bath according to claim 3, wherein the sulfur-containing compound of the corresponding gold complex contains at least one member selected from the group consisting of 2-mercaptoethanesulfonic acid, 3-mercaptopropanesulfonic acid, 2,3-dimercaptopropanesulphonic acid, bis-(2-sulfopropyl)disulfide, bis-(3-sulfopropyl)disulfide and the alkali metal salts thereof.

5. The cyanide-free electroplating bath according to claim 3, which contains 0.01 to 10 g/l of wetting agent in the form of a surfactant and 0.1 to 1000 mg/l of brightener in the form of selenium and/or tellurium compounds.

6. The cyanide-free electroplating bath according to claim 1, wherein the sulfur-containing compound of the corresponding gold complex contains at least one member selected from the group consisting of 2-mercaptoethanesulfonic acid, 3-mercaptopropanesulfonic acid, 2,3-dimercaptopropanesulfonic acid, bis-(2-sulfopropyl)disulfide, bis-(3-sulfopropyl)disulfide, and the alkali metals salts thereof.

7. The cyanide-free electroplating bath according to claim 6, which contains 0.01 to 10 g/l of wetting agent in the form of a surfactant and 0.1 to 1000 mg/l of brightener in the form of selenium and/or tellurium compounds.

8. The cyanide-free electroplating bath according to claim 1, which contains 0.01 to 10 g/l of wetting agent in the form of a surfactant and 0.1 to 1000 mg/l of brightener in the form of selenium and/or tellurium compounds.

9. A process for the electrodeposition of gold and gold alloys from a cyanide-free electroplating bath, comprising immersing a cathode in a bath according to claim 1 and subjecting said bath and cathode to electrolysis to deposit a gold or gold alloy of said cathode.

10. The process according to claim 9, wherein the bath is operated at a pH value of from 7 to 12.

11. The process according to claim 10, wherein the bath is operated at a current density above 1 $A/dm^2$ at a temperature of 50 to 55° C.

12. The process according to claim 9, further comprising codepositing gold with an element selected from the group consisting of silver, copper, indium, cadmium, tin, zinc, bismuth, arsenic and antimony.

* * * * *